United States Patent [19]

Titolo

[11] Patent Number: 4,693,214

[45] Date of Patent: Sep. 15, 1987

[54] TAPPET SYSTEM FOR INTERNAL COMBUSTION ENGINES HAVING SHAFTS WITH VARIABLE-PROFILE CAMS

[75] Inventor: Andrea Titolo, Turin, Italy

[73] Assignee: Fiat Auto S.p.A., Turin

[21] Appl. No.: 877,937

[22] Filed: Jun. 24, 1986

[30] Foreign Application Priority Data

Jul. 2, 1985 [IT] Italy ..... 67604 A/85

[51] Int. Cl.[4] ..... F01L 1/34

[52] U.S. Cl. ..... 123/90.18; 123/90.27

[58] Field of Search ..... 123/90.18, 90.27, 90.48, 123/90.49, 90.15

[56] References Cited

U.S. PATENT DOCUMENTS

| | | | |
|---|---|---|---|
| 905,733 | 12/1908 | Miller | 123/90.49 |
| 1,100,912 | 6/1914 | Rich | 123/90.49 |
| 1,123,142 | 12/1914 | Rich | 123/90.49 |
| 1,413,535 | 4/1922 | Jerdone | 123/90.49 |
| 1,579,850 | 4/1926 | Wittig | 123/90.49 |
| 1,613,012 | 1/1927 | Baker | 123/90.49 |
| 2,051,313 | 8/1936 | Olenick | 123/90.48 |
| 4,284,042 | 8/1981 | Springer | 123/90.27 |
| 4,570,581 | 2/1986 | Titolo | 123/90.18 |
| 4,587,934 | 5/1986 | Moores | 123/90.18 |

FOREIGN PATENT DOCUMENTS

| | | | |
|---|---|---|---|
| 1098374 | 7/1955 | France | 123/90.49 |
| 0775358 | 11/1980 | U.S.S.R. | 123/90.48 |

*Primary Examiner*—Craig R. Feinberg
*Assistant Examiner*—David A. Okonsky
*Attorney, Agent, or Firm*—Sughrue, Mion, Zinn, Macpeak, and Seas

[57] ABSTRACT

In an internal combustion engine having shafts with variable-profile cams, a tappet system is used which includes an oscillating shoe with a flat, rectangular contact surface, a shoe-carrying saddle having an anti-rotation guide and shoulders for containing the shoe, and a cup in which the shoe-carrying saddle is inserted.

3 Claims, 2 Drawing Figures

TAPPET SYSTEM FOR INTERNAL COMBUSTION ENGINES HAVING SHAFTS WITH VARIABLE-PROFILE CAMS

The surface of the present invention is a tappet system for internal combustion engines using shafts with variable profile cams, comprising an oscillating shoe, a shoe-carrying saddle, and a cup.

The timing control with variable-profile cams is used to vary the amplitude and times of opening of the valves by means of an axial displacement of the camshaft in dependence on the speed of rotation of the engine in order to optimise the performance and fuel consumption.

With this type of cam, the line of contact between the tappet and the cam lies in a plane which is never perpendicular to the axis of the tappet as occurs in timing controls with fixed-profile cams, but forms an angle therewith which changes in dependence on the longitudinal position of the cam relative to the tappet.

This makes it necessary to use a type of tappet which compensates for these angular variations without however being too complicated or heavy so as to avoid other disadvantages.

From published Italian Patent Application No. 68914-A/82 in the name of the same Applicants, a tappet system is known in which the element in contact with the surface of the cam is constituted by a shoe pivotable in a shoe-carrying saddle provided with anti-rotation guides and the cup of which has shoulders containing the shoe-carrying saddle.

The particular construction of a shoe-carrying saddle incorporating the guides makes the whole thing very heavy with obvious disadvantages at high rates of rotation. Furthermore, because of the particular conformation of the guides, it is necessary to work the head.

The object of the present invention is to provide a tappet system which enables these disadvantages to be avoided.

This object is achieved by means of a tappet system for engines having shafts with variable-profile cams, of the type comprising a shoe, a shoe-carrying saddle, and a cup slidable in the seat formed in the head, and in which the shoe has a flat, rectangular cam-shoe contact surface and is provided on its surface opposite the contact surface with a semi-circular-sectioned projection whose axis is perpendicular to the axis of the cam shaft, characterised in that the shoe-carrying saddle has a seat in its upper surface for coupling with the projection, two tabs disposed on diametrally opposite faces of the saddle for centering it in the cup, and an extension coaxial with the seat arranged to prevent its rotation about the valve axis in cooperation with a retaining element fixed in the head.

Further characteristics and advantages will become clear from the description which follows with reference to the appended drawings, provided purely by way of non-limiting example, in which.

Figure 1:
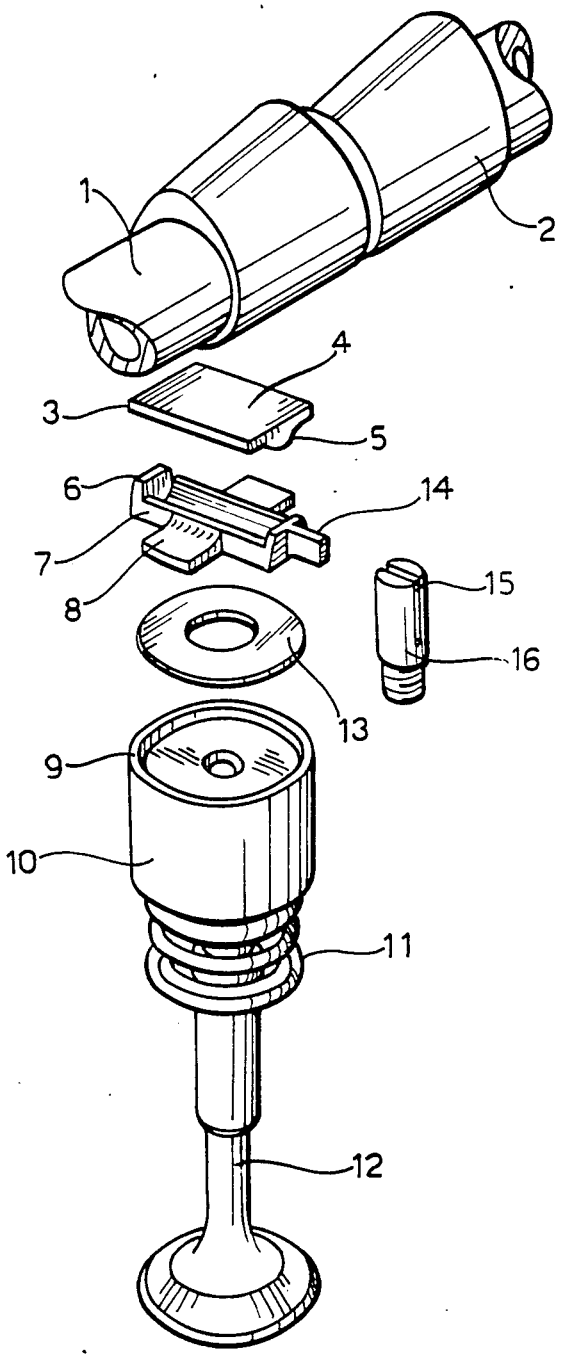
FIG. 1 is an exploded view of the tappet of the invention.
Figure 2:
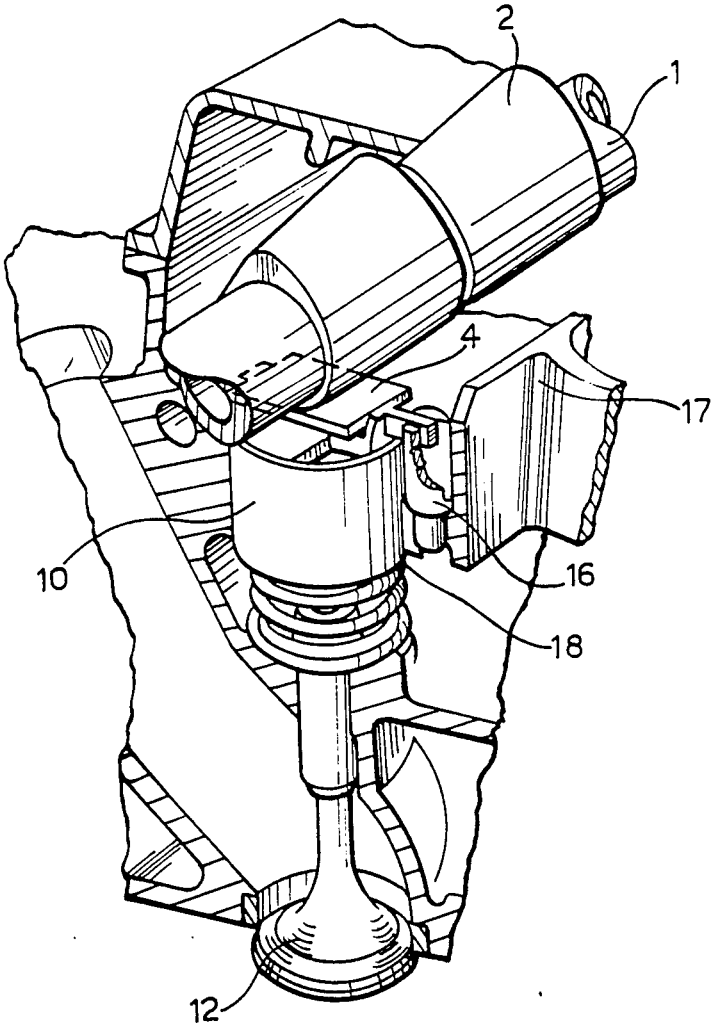
FIG. 2 is a view of the device of FIG. 1 inserted in the head of an engine.

With reference to the drawings, a shaft 1 has variable-profile cams 2 and is used in an internal combustion engine for controlling the opening and closing of the valves.

A rectangular shoe, indicated 3, has a flat shoe-cam contact surface 4.

The shoe has a lower projection 5 which is of semi-circular section and is coaxial with the longer axis of the shoe.

The projection 5 of the shoe rests in a semi-circular-sectioned seat 6 formed in a shoe-carrying saddle 7.

This coupling allows the shoe to rotate about its longitudinal axis and the contact surface 4 thus to follow the variations of the inclination of the cam.

The shoe-carrying saddle 7 has two tabs 8 disposed diametrally opposite each other in the central positions on the larger faces of the saddle and arranged to be inserted in a circular seat 9 formed in the upper surface of the cup 10 surrounding the spring 11 of the valve 12.

Thus, the saddle 7 is centered relative to the cup which is however free to rotate about its axis.

The circular seat 9 also serves for the insertion of setting discs 13 for the tappet clearance.

The shoe-carrying saddle 7 is also provided with an extension 14 which is coaxial with its longer axis and is slidably inserted in a notch 15 formed in a screw 16 screwed into the head 17 of the engine close to the sliding seat 18 for the cup 10.

This prevents rotation of the saddle 7 the axis of which is kept perpendicular to the axis of the shaft 1.

The length of the notch 13 will be calculated so as not to affect the movement of the tappet during opening of the valve.

What is claimed is:

1. Tappet system for engines having a head and a camshaft with variable-profile cams, of the type comprising a shoe, a shoe-carrying saddle, and a cup slidable in the head, and in which the shoe has a flat, rectangular cam-shoe contact surface and is provided on its surface opposite the contact surface with a semi-circular-sectioned projection whose axis is perpendicular to a longitudinal axis of the camshaft, wherein the shoe-carrying saddle has a seat in its upper surface for coupling with the projection, two tabs disposed on diametrally opposite faces of the saddle for centering it in the cup, and an extension coaxial with the seat, and wherein a retaining element is fixed in the head and is arranged to cooperate with the extension of the saddle to prevent rotation of the saddle about the valve axis.

2. Tappet system according to claim 1, wherein the retaining element is constituted by a screw having a notch.

3. Tappet system according to claim 1, wherein the cup has a circular seat in its upper surface for coupling with the shoe-carrying saddle.

* * * * *